United States Patent [19]

Armstrong et al.

[11] 3,984,169

[45] Oct. 5, 1976

[54] KEYING FOR LEVER ACTION CONNECTORS

[75] Inventors: Charles C. Armstrong; Lynn E. Ripley; Douglas Houston, all of Huntington, W. Va.

[73] Assignee: Harvey Hubbell Incorporated, Bridgeport, Conn.

[22] Filed: Mar. 10, 1972

[21] Appl. No.: 233,568

[52] U.S. Cl. ..... 339/184 M; 339/91 R

[51] Int. Cl.[2] ..... H01R 13/64

[58] Field of Search ..... 339/39, 43, 44, 75 R, 339/75 M, 119 R, 125 R, 126 R, 176 R, 176 M, 184–186, 5, 18 B, 91; 16/171–177

[56] References Cited

UNITED STATES PATENTS 2,542,404 2/1951 Ensign ..... 339/91 R X

FOREIGN PATENTS OR APPLICATIONS 708,208 7/1931 Germany ..... 339/184 R

*Primary Examiner*—Lawrence J. Staab

*Attorney, Agent, or Firm*—Wooster, Davis & Cifelli

[57] ABSTRACT

Apparatus for keying the pivotal action of a lever action connector particularly where engagement criteria between the plug and receptacle is necessary to provide a multiple characteristic discrimination. The engagement criteria are incorporated between the complementary elements of the swivel means to render the assembly thereof impossible when an incompatibility exists therebetween. Each engagement criterion is attained by the compatible mating of a male key disposed on the receptacle with a female slot disposed on the plug. The engagement criterion may be either fixed or variable and if desirable, both fixed and variable criteria may be utilized in the same connector.

7 Claims, 5 Drawing Figures

KEYING FOR LEVER ACTION CONNECTORS

BACKGROUND OF THE INVENTION

The present invention relates to keying apparatus for a lever action connector, and more particularly, to such apparatus for providing multiple characteristic discrimination with either fixed or variable engagement criteria between the plug and receptacle.

Hitherto many different devices have been used to key the engagement between the plug and receptacle of connectors, however, most of these devices are operable only in linear action connectors and are irrelevant to lever action connectors. Many devices are limited to a single characteristic discrimination and some devices are limited to fixed choice discriminations because the keying positions can not be variably located. In other devices electrical engagement is possible before keying incompatibility occurs between the plug and receptacle which precludes use thereof in power distribution applications.

SUMMARY OF THE INVENTION

It is, therefore, a general object of the present invention to provide a lever action connector having keying apparatus which minimizes and obviates the disadvantages of the prior art.

It is a specific object of the present invention to provide a lever action connector having keying apparatus which discriminates in regard to a plurality of characteristics.

It is a more specific object of the present invention to provide a lever action connector having keying apparatus which establishes both fixed and variable choice discriminations.

It is another object of the present invention to provide a lever action connector having keying apparatus which precludes assembly of the swivel means when incompatible engagement criteria exists therein.

It is still another object of the present invention to provide a lever action connector having keying apparatus which improves the alignment between the male and female terminals of the connector.

These objects are accomplished in one form according to the present invention by incorporating the keying provisions into the complementary swivel means existing between the plug and receptacle of the lever action connector. Each keying provision is established by the compatible engagement of a key disposed on the receptacle into a slot disposed on the plug. Two types of keys are available, a master key and a selector key. The master key is embossed on the receptacle and provides a fixed engagement criterion, while the selector key is selectively located on the receptacle and provides a variable engagement criterion. Supplemental support is provided for the complementary swivel means by either key which thereby improves the alignment between the male and female terminals of the connector.

BRIEF DESCRIPTION OF THE DRAWINGS

The manner in which these and other objects of the invention are achieved will be best understood by reference to the following description, the appended claims, and the attached drawings wherein:

DESCRIPTION OF THE PREFERRED EMBODIMENT

Figure 1:
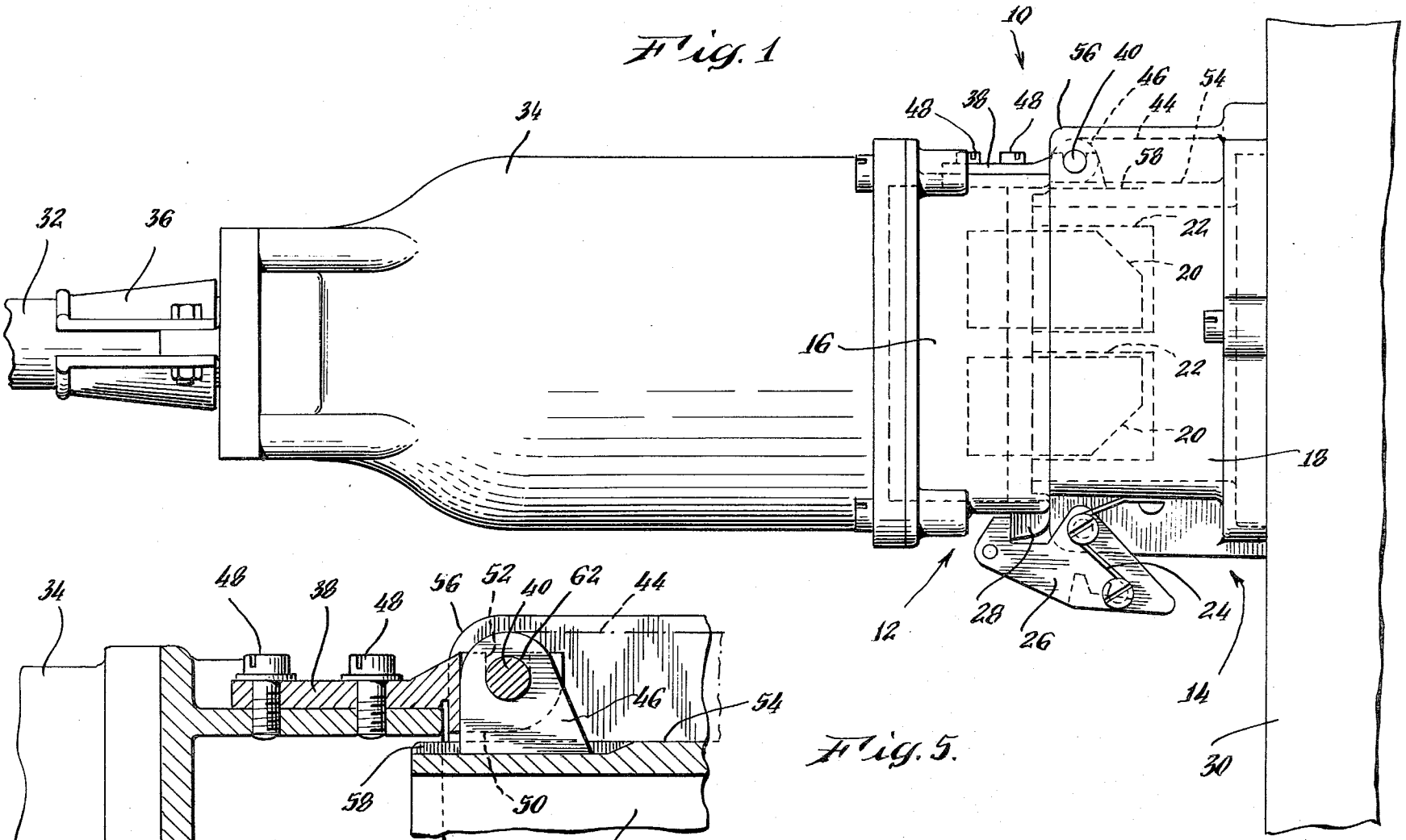
FIG. 1 is a side elevational view of a lever action connector mounted to a power distribution panel and incorporating the keying apparatus of this invention.

Turning now to the drawings, and more particularly to FIG. 1, there is illustrated a lever action connector 10 into which the keying apparatus of this invention has been incorporated. Electrical interconnections are accomplished within the connector 10 by engaging a plug 12 into a receptacle 14. The plug 12 is contained within a plug housing 16 and the receptacle 14 is contained within a receptacle housing 18. During engagement of the plug 12 into the receptacle 14, terminal blades 20 secured within the plug housing 16 are directed into terminal slots 22 secured within the receptacle housing 18. Both the terminal blades 20 and the terminal slots 22 connect to wires by suitable means such as screw lugs (not shown).

In a lever action connector 10, the engagement is the result of pivotal motion between the plug 12 and the receptacle 14. This pivotal motion is sustained by incorporating a complementary swivel means between the plug 12 and the receptacle 14. Pivotal motion engagement is more positive and is more readily attained than engagement resulting from linear motion along an axis common to both plug and receptacle. A latching means is provided to retain the assembly of the connector 10 on completion of the pivotal motion engagement. This latching means consists of disposing a spring 24 to bias a latch 26, on the receptacle 14, and disposing a latching lip 28 on the plug 12.

Many applications for lever action connectors 10 exist and one of the most common is shown in FIG. 1 where power is distributed to electrical equipment (not shown) from a power distribution panel 30. In such an application, the receptacle 14 is affixed to the power distribution panel 30 and a cable 32 interconnects the plug 12 to the electrical equipment. A boot 34 is affixed on the back of the plug 12 to enclose the electrical connections of the cable 32 to the terminal blades 20 and a cable clamp 36 is affixed to the boot 34 for reducing the stress applied to these connections through the cable 32.

On most power distribution panels 30, electrical power in compliance with many different electrical characteristics is available from a plurality of receptacles 14. An example of this would be for the power distribution panel 30 to supply both alternating current and direct current at different voltage levels. The cable 32 contains electrical wires and is rated as to specific electrical characteristics, an example of which would be a voltage or current limitation. Therefore, to assure that electrical equipment is supplied with power complying with particular electrical characteristics and that such power is distributed through cables 32 having compatible ratings thereto, this invention has incorporated a complementary keying means into the complementary swivel means of the lever action connector 10.

Figure 5:
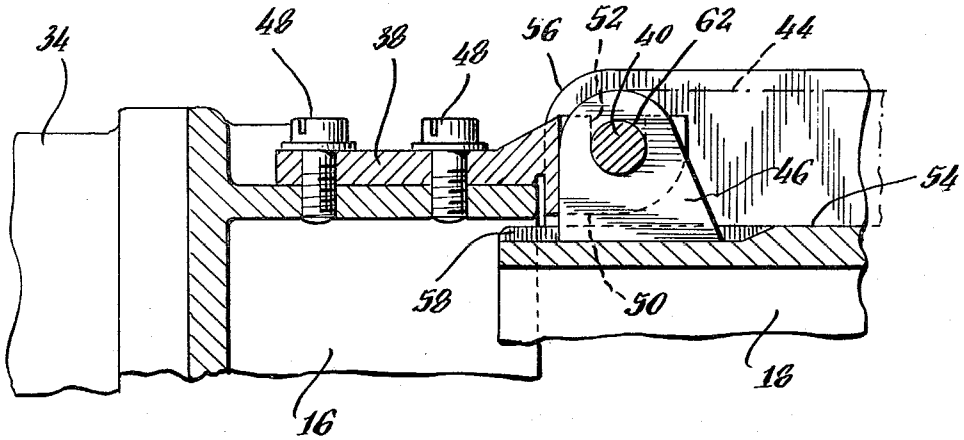
FIG. 5 is an enlarged fragmentary view of FIG. 1 with portions of the connector cut away to illustrate the incorporation of the complementary keying means into the complementary swivel means.
Figure 2:
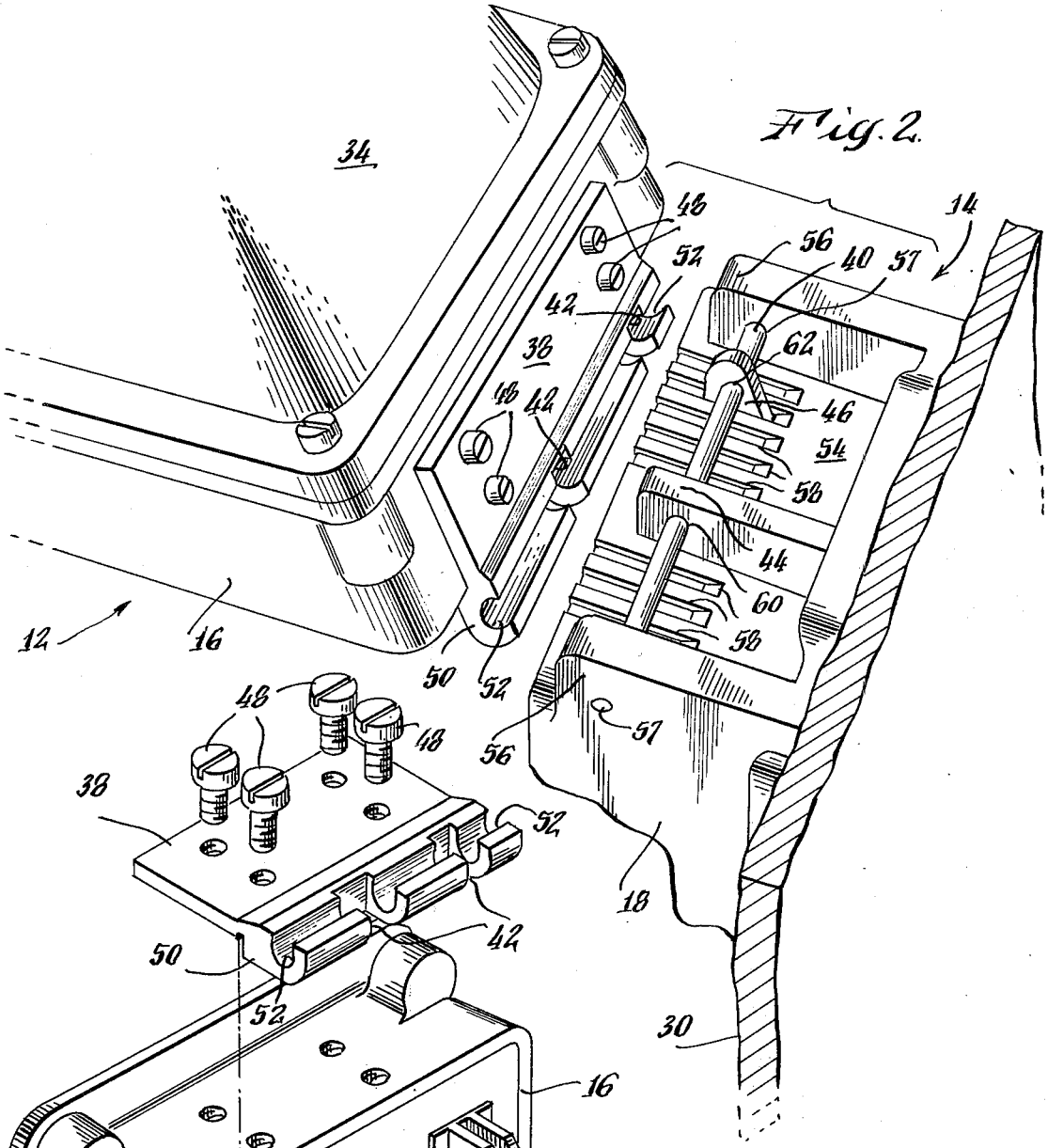
FIG. 2 is a perspective view of a lever action connector plug being presented for pivotal engagement into a lever action connector receptacle.

As illustrated in FIGS. 2 and 5 the complementary swivel means between the plug 12 and receptacle 14 consists of a swivel bracket 38 affixed to the plug housing 16 and a swivel pin 40 supported on the receptacle housing 18. The complementary keying means is incorporated within the complementary swivel means by establishing engagement criteria therein with male keys disposed about the swivel pin 40 to mate with female slots 42 disposed in the swivel bracket 38. Two types of male keys can be disposed about the swivel pin 40, a master key 44 and a selector key 46. The type of male key utilized depends on whether the electrical characteristic to be discriminated has a fixed or variable nature and when desirable both types of keys may be used.

Figure 3:
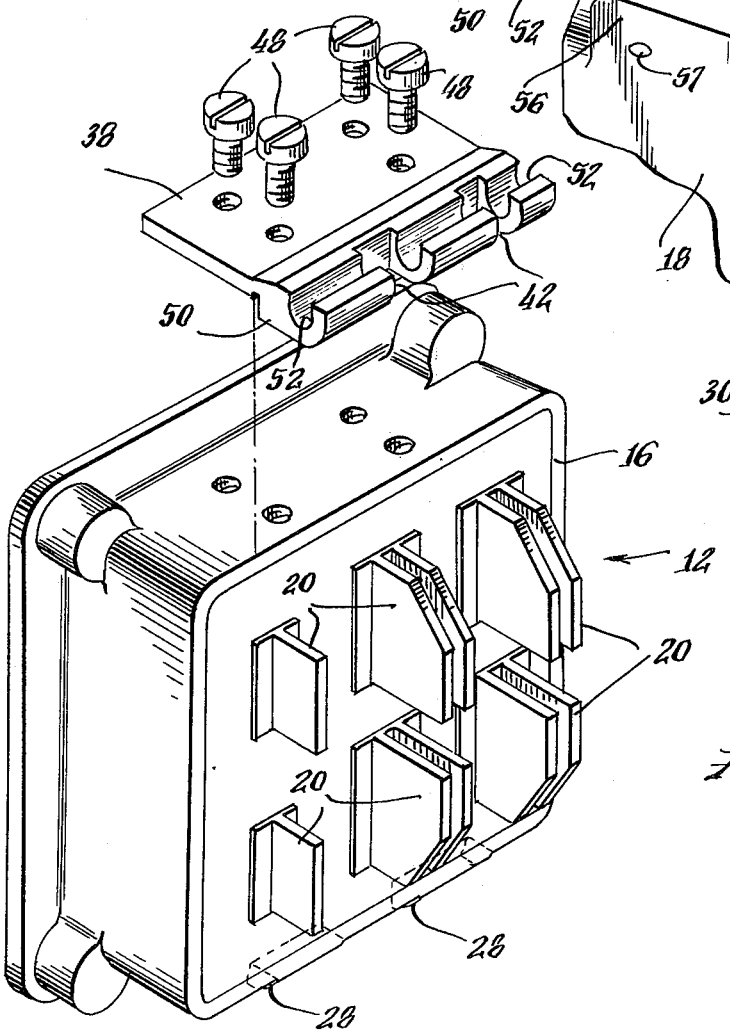
FIG. 3 is an exploded view of the lever action connector plug.

The swivel bracket 38 is affixed to the plug housing 16 by any suitable means such as screws 48, as illustrated in FIG. 3. A portion 50 of the swivel bracket 38 extends over the edge of the plug housing 16 and is configured laterally across its surface with an open ended channel 52. The slots 42 are located perpendicularly across the channel 52 at preselected positions to establish female engagement criteria. Each discrimination desired requires a particular slot pattern and therefore a different swivel bracket 38 is necessary for each characteristic or combination of characteristics discriminated.

Figure 4:
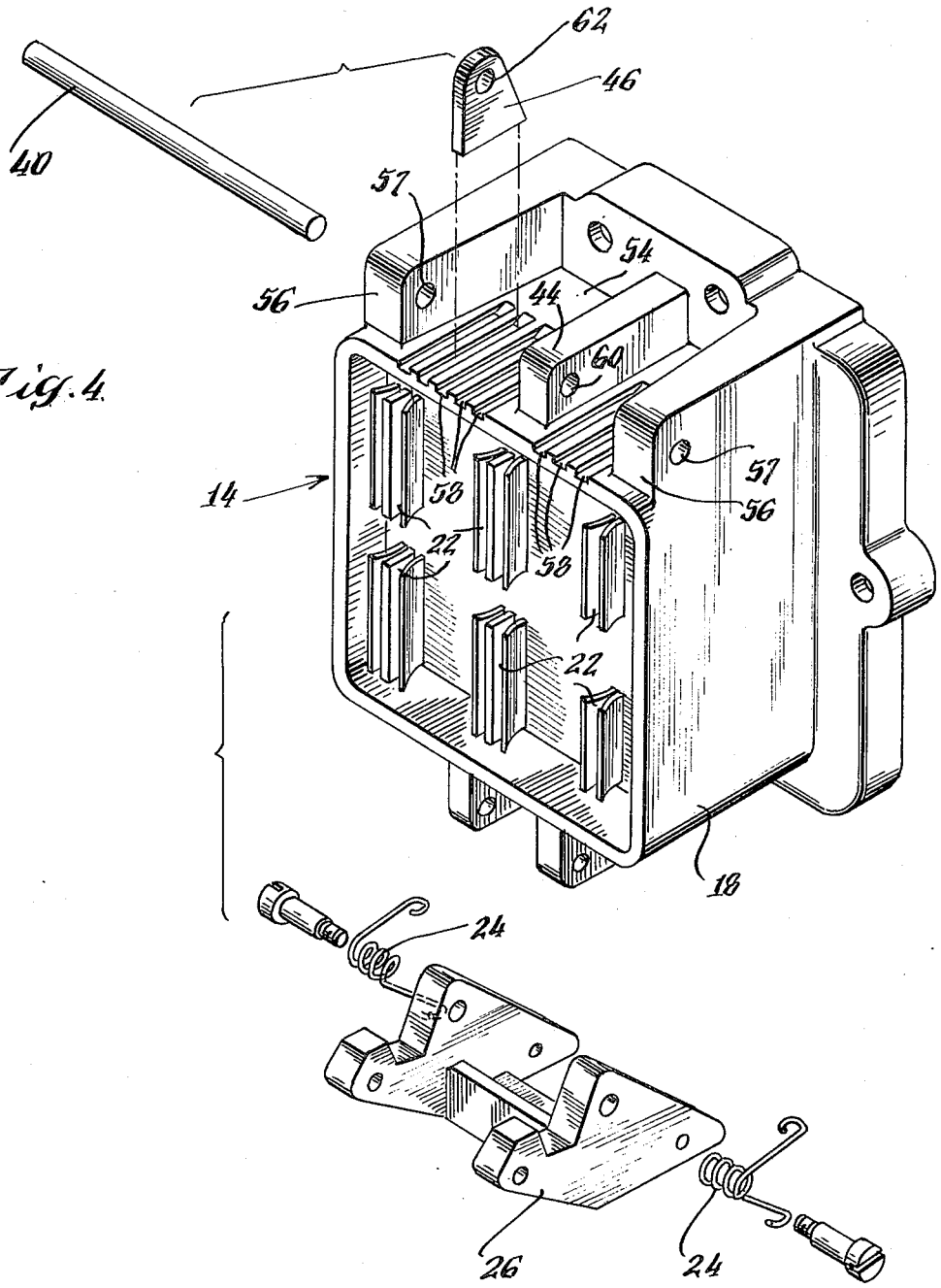
FIG. 4 is an exploded view of the lever action connector receptacle.

As illustrated in FIG. 4, the swivel pin 40 is supported across an exterior surface 54 of the receptacle housing 18 in ears 56 extending therefrom by suitable means such as an interference fit into apertures 57. A plurality of parallel grooves 58 are disposed across the exterior surface 54 between the ears 56 and in a direction perpendicular to the axis of the swivel pin 40. The master key 44 is an embossment disposed on the exterior surface 54 between the ears 56 and has an aperture 60 through which the swivel pin 40 passes. The selector key 46 is an independent piece of metal, the thickness of which is complementary to the width of each groove 58. An aperture 62 is provided in the selector key 46 through which the swivel pin 40 passes after the selector key 46 has been positioned within one of the grooves 58. Either or both keys 44 and 46 are located at preselected positions to establish male engagement criteria and a particular key pattern must exist for each characteristic or combination of characteristics discriminated.

In operation, the complementary swivel means sustains pivotal motion between the plug 12 and the receptacle 14 when the swivel bracket 38 is connected to the swivel pin 40. This connection is accomplished by tilting the plug 12 relative to the receptacle 14 as illustrated in FIG. 2, so as to locate the swivel pin 40 within the channel 52 on the swivel bracket 38. As illustrated in FIG. 5, the swivel bracket 38 pivots about the swivel pin 40 to sustain pivotal motion between the plug 12 and receptacle 14. During this pivotal motion the terminal blades 20 of the plug 12 are directed into the terminal slots 22 of the receptacle 14. Pivotal motion is terminated when the terminal blades 20 are fully engaged into the terminal slots 22, with the plug 12 in flush contact against receptacle 14. In this closed position, the latch 26 is disposed over the latching lip 28 and biased thereagainst by spring 24, as illustrated in FIG. 1.

In operation, the complementary keying means establishes engagement criteria which must be compatible before the swivel bracket 38 can be connected with the swivel pin 40 in establishing the complementary swivel means. The engagement criteria is compatible whenever the slots 42 in the swivel brackets 38 are located to mate with the keys 44 and/or 46 disposed about the swivel pin 40. Before compatible engagement criteria can be established, the electrical characteristics or combination of characteristics to be discriminated must first be determined. As previously discussed, the plug 12 is usually interconnected to electrical equipment by the cable 32 and the receptacle 14 is usually affixed to a power distribution panel 30. Therefore, the swivel bracket 38 mounted to each plug 12 is selected to discriminate in regard to the predetermined electrical characteristics applicable to the electrical equipment and/or the cable 32, while each receptacle 14 is adapted to discriminate in regard to the predetermined electrical characteristics applicable to the power supplied from the power distribution panel 30.

The choice of female engagement criteria for each plug 12 may be varied by merely changing the swivel bracket 38. The choice of male engagement criteria for each receptacle 14 may be either fixed or variable. If the master key 44 is utilized, the male engagement criterion is fixed because the location of the master key 44 can only be varied by changing the receptacle housing 18 in which the receptacle 14 is contained. If the selector key 46 is utilized, the male engagement criterion is variable because the swivel pin 40 can be removed and the selector key 46 relocated in any of the grooves 58. As illustrated in FIG. 2, both the master key 44 and the selector key 46 may be utilized together to accomplish a more inclusive and flexible discrimination. Of course the male keys 44 and 46 could be disposed on the plug 12 and the female slots 42 could be disposed on the receptacle, should such an arrangement be desirable.

In a lever action connector 10, the alignment between the terminal blades 20 in the plug 12 and the terminal slots 22 in the receptacle 14 is adversely affected by any deflection of the swivel pin 40 during the pivotal motion. When the complementary keying means is utilized a more precise alignment between the terminal blades 20 and the terminal slots 22 is assured. This is so because the master key 44 and the selector key 46 are both disposed between the ears 56 and therefore serve to reduce the unsupported length of the swivel pin 40. This reduction in unsupported length makes the swivel pin 40 more rigid to forces applied when pivotal motion is sustained by the complementary swivel means and therefore deflection of the swivel pin 40 is decreased.

It should be readily appreciated by those skilled in this art that the keying apparatus embodied in this invention provides for a multiple characteristic discrimination in a lever action connector and that the discriminations may present either a fixed or variable choice. Also, the keying apparatus establishes engagement criteria which precludes assembly of the swivel means within the lever action connector when an incompatibility exists. Furthermore, a more precise alignment between the male terminal blades and the female terminal slots of the connector is attained when the keying apparatus is incorporated.

It should be understood that the present disclosure has been made only by way of example and that numerous changes in details of construction and the combination or arrangement of parts may be resorted to without departing from the true spirit or scope of the invention and therefore this disclosure should be construed as illustrative rather than limiting.

What is claimed is:

1. A lever action connector apparatus comprising:

a receptacle;

a plug;

complementary swivel means for sustaining pivotal motion between said receptacle and said plug; and variably positioned keying means for establishing an engagement criterion between said plug and said receptacle at selected locations within said complementary swivel means.

2. The apparatus of claim 1 wherein said variably positioned keying means includes a male key and a female slot, said male key being removable from within said complementary swivel means and selectively located therein from grooves on said connector apparatus, said grooves being oriented perpendicularly to the pivotal axis of said complementary swivel means.

3. The apparatus of claim 2 wherein said complementary swivel means includes a swivel pin and a swivel bracket, said swivel bracket connecting with said swivel pin to sustain pivotal motion between said plug and said receptacle, said female slot being disposed in said swivel bracket, said swivel bracket being detachably affixed to said connector apparatus.

4. The apparatus of claim 3 wherein said male key extends perpendicularly across said swivel pin, said male key being configured to pass said swivel pin therethrough, said swivel pin being supported on said connector apparatus by said male key to assure precise pivotal alignment between engaging contacts of said plug and said receptacle.

5. A lever action connector apparatus comprising:

a receptacle;

a plug; and complementary swivel means for sustaining pivotal motion between said receptacle and said plug, said complementary swivel means including a plurality of male keys and female slots, said male keys and said female slots being compatibly configured and disposed within said complementary swivel means to establish engagement criteria between said plug and said receptacle, one of said male keys being an integral embossment on said connector to present a fixed choice male engagement criterion, and another of said male keys being independent of said connector and selectively located thereon to present a variable choice male engagement criterion, said complementary swivel means being inoperable when either engagement criterion between said male keys and said female slots is incompatible.

6. The apparatus of claim 5 wherein said complementary swivel means includes a swivel pin supported on said receptacle and a swivel bracket affixed to said plug, said swivel bracket connecting with said swivel pin to sustain said pivotal motion between said plug and said receptacle, said male keys being disposed on said receptacle and said female slots being disposed in said swivel bracket; and wherein said male keys are disposed around said swivel pin, said swivel pin being supported by said male keys to assure precise pivotal alignment between engaging terminals of said connector.

7. In an electrical coupling system of the type including an electrical receptacle comprising a housing having a plurality of internal electrical contacts on its interior, a power plug having a plurality of external contacts engageable with the contacts of the receptacle upon alignment of the plug contacts with the receptacle contacts and inward movement of the plug contacts into the receptacle, a first external connector hinge portion mounted on the exterior of said receptacle, a second external connector hinge portion on said plug mateable with said first external connector hinge portion for pivotal movement about said first external connector hinge portion to move the plug contacts into the receptacle for engagement with the receptacle contacts, the improvement comprising first key means comprising a collar mounted on a shaft on the housing and forming part of the first external connector hinge portion and second key means on the second external connector hinge portion, said second key means being positioned and dimensioned to matingly fit with said collar and permit the second external connector hinge portions to matingly fit over portions of the shaft adjacent the collar and permit pivotable movement of the external contacts into the internal contacts when the current capacity characteristics of the particular plug and the current capacity characteristics of the particular receptacle are the same but preventing the first and second hinge portions from mating and enabling movement of the external contacts into the internal contacts when the current capacity characteristics of the plug is different from the current capacity characteristics of the receptacle wherein said second hinge portion comprises a hinge plate and additionally includes removable connector means removably connecting said hinge plate to said plug so that a different hinge plate having a different second key means position in a different transverse position can be attached to the plug so that the plug can then be used only with receptacles having a collar located in transverse alignment with said different second key means position.

* * * * *